US011401767B2

(12) United States Patent
Wright et al.

(10) Patent No.: US 11,401,767 B2
(45) Date of Patent: Aug. 2, 2022

(54) TORQUE RELEASE TUBING ROTATOR, TUBING HANGER, AND SYSTEM

(71) Applicant: Risun Oilflow Solutions Inc., Nisku (CA)

(72) Inventors: Andrew Wright, Nisku (CA); Phillip Man Tong, Edmonton (CA)

(73) Assignee: RISUN OILFLOW SOLUTIONS INC., Nisku (CA)

( * ) Notice: Subject to any disclaimer, the term of this patent is extended or adjusted under 35 U.S.C. 154(b) by 0 days.

(21) Appl. No.: 16/982,025

(22) PCT Filed: Mar. 19, 2019

(86) PCT No.: PCT/CA2019/050337
§ 371 (c)(1),
(2) Date: Sep. 17, 2020

(87) PCT Pub. No.: WO2019/178685
PCT Pub. Date: Sep. 26, 2019

(65) Prior Publication Data

US 2021/0017829 A1 Jan. 21, 2021

Related U.S. Application Data

(60) Provisional application No. 62/657,286, filed on Apr. 13, 2018, provisional application No. 62/644,967, filed on Mar. 19, 2018.

(51) Int. Cl.
*E21B 33/04* (2006.01)

(52) U.S. Cl.
CPC ..... *E21B 33/0415* (2013.01)

(58) Field of Classification Search
CPC ..... E21B 33/0415
See application file for complete search history.

(56) References Cited

U.S. PATENT DOCUMENTS 3,483,774 A 12/1969 Dickmann et al.
5,383,519 A * 1/1995 Wright ..... E21B 33/0415 166/104
5,427,178 A * 6/1995 Bland ..... E21B 33/0415 166/78.1

(Continued)

FOREIGN PATENT DOCUMENTS

WO 2016176774 11/2016

*Primary Examiner* — Aaron L Lembo
(74) *Attorney, Agent, or Firm* — Foley & Lardner LLP

(57) ABSTRACT

The disclosure provides a torque release tubing rotator comprising a rotator body and a split drive mandrel rotatably coupled to the rotator body. The split drive mandrel receives and engages at least a portion of a tubing hanger. The split drive mandrel comprises an outer driven portion, an inner mandrel portion, and a one-way locking mechanism coupling the outer driven portion and the inner mandrel portion. The disclosure also provides a torque release tubing hanger for a tubing rotator comprising an outer housing, a tubing mandrel suspended from the outer housing, and a locking swivel rotatably coupled to the outer housing. The locking swivel is movable between a locked configuration and an unlocked configuration. A bi-directional coupling is also provided. The disclosure also provides a torque release tubing rotator system comprising the tubing rotator and tubing hanger.

24 Claims, 13 Drawing Sheets

(56) References Cited

U.S. PATENT DOCUMENTS

| | | | | | |
|---|---|---|---|---|---|
| 5,429,188 | A * | 7/1995 | Cameron | E21B 33/0415 | 166/117.7 |
| 5,465,788 | A * | 11/1995 | Wright | E21B 33/0415 | 166/379 |
| 5,642,782 | A * | 7/1997 | Grimshaw | E21B 17/04 | 166/237 |
| 5,732,777 | A * | 3/1998 | Grimshaw | E21B 33/0415 | 166/382 |
| 6,026,898 | A * | 2/2000 | Bland | E21B 33/0415 | 166/78.1 |
| 6,039,115 | A | 3/2000 | Mills | | |
| 6,199,630 | B1 * | 3/2001 | Blundell | E21B 33/0415 | 166/75.14 |
| 6,289,986 | B1 | 9/2001 | Wright et al. | | |
| 6,543,533 | B2 * | 4/2003 | Meek | E21B 33/0415 | 166/104 |
| 6,640,892 | B1 * | 11/2003 | Wright | E21B 33/0415 | 166/68.5 |
| 9,541,073 | B2 * | 1/2017 | Rappenecker | F16H 37/122 | |
| 10,605,014 | B2 * | 3/2020 | Scekic | E21B 19/06 | |
| 2002/0121367 | A1 | 9/2002 | Meek et al. | | |
| 2006/0011339 | A1 | 1/2006 | Wright et al. | | |
| 2018/0148990 | A1 * | 5/2018 | Wright | E21B 19/02 | |
| 2019/0368323 | A1 * | 12/2019 | Wright | E21B 33/0415 | |

* cited by examiner

TORQUE RELEASE TUBING ROTATOR, TUBING HANGER, AND SYSTEM

RELATED APPLICATIONS

This application claims priority to U.S. Provisional Patent Application Nos. 62/644,967, filed Mar. 19, 2018, and 62/657,286, filed Apr. 13, 2018, the entire contents of which are incorporated herein by reference.

FIELD OF THE DISCLOSURE

The disclosure relates to tubing rotator systems in well operations. More particularly, the disclosure relates to tubing rotators and tubing hangers used with the rotators.

BACKGROUND

Fluids pumped from wellbores utilizing a downhole pump are typically transported to the surface through the use of production tubing such as a tubing string. To minimize wear on the inside surface of the production tubing through contact with the pump rod, and to extend the useful life of the string, a production tubing rotator may be used to slowly rotate the production tubing within the well casing and to more evenly distribute wear about the inside surface of the string.

A tubing rotator system may comprise a tubing rotator with a drive mandrel and a tubing hanger mounted in the drive mandrel or well head. The drive mandrel may impart rotational movement to the tubing hanger, which in turn rotates the production tubing suspended from the hanger. In order to cause the production tubing to revolve within the casing, tubing rotators commonly utilize a mechanical linkage connecting a drive system to the drive mandrel of the rotator.

During use of a tubing rotator, torque can build up in the production tubing from the rotation, and some torque may still be trapped in the production tubing when the rotator stops rotating the string. Conventional tubing rotators may hold the torque in the production tubing with no mechanism to release the torque or allow controlled back spin downhole. The trapped torque may instead need to be backed off at the surface, which may present safety issues in conventional rotators when the well head is dismantled for servicing of the well. The trapped torque can cause a dangerous backspin of the tubing hanger during servicing of the tubing rotator or other wellhead equipment. The backspin can cause damage to equipment and/or injury or even death of workers in the vicinity.

SUMMARY

According to an aspect, there is provided a tubing rotator, comprising: a rotator body for mounting to wellhead equipment, the rotator body defining a first bore therethrough; a split drive mandrel mounted in the first bore and rotatably coupled to the rotator body, the split drive mandrel defining a second bore therethough for receiving at least a portion of a tubing hanger therein, and comprising: an outer driven portion; an inner mandrel portion; and a one-way locking mechanism coupling the outer driven portion and the inner mandrel portion.

In some embodiments, the one-way locking mechanism engages to rotationally lock the inner mandrel portion with the outer driven portion when the outer driven portion is rotated in a first direction; and when disengaged, the one-way locking mechanism allows the inner mandrel portion to rotate with respect to the outer driven portion in a second rotation direction opposite to the first rotation direction.

In some embodiments, the one-way locking mechanism comprises a one-way clutch.

In some embodiments, the one-way clutch comprises a one-way friction clutch.

In some embodiments, the one-way friction clutch comprises: an outer guide defined by an inner surface of the outer mandrel portion; an inner guide defined by an outer surface of the inner mandrel portion; and a plurality of engagement elements received in between the inner and outer guides.

In some embodiments, one of the inner guide and the outer guide defines a plurality of tapered recesses, and each of the engagement elements is positioned in a respective one of the tapered recesses, and wherein each said tapered recess is shaped such that movement of the outer guide in the first rotation direction causes the engagement elements to frictionally engage the inner and outer guides.

In some embodiments, the tubing rotator further comprises a mechanical linkage coupled to the outer driven portion and couplable to a drive system to transfer torque from the drive system to the outer driven portion.

In some embodiments, the tubing rotator further comprises a bi-directional coupling mechanism for coupling the mechanical linkage to a drive shaft of the drive system, the bi-directional coupling allowing the mechanical linkage to be: driven in a forward direction by the drive system to rotate the outer driven portion in the first rotation direction; and moved in a reverse direction to rotate the outer driven portion in the second rotation direction.

In some embodiments, the outer driven portion comprises outer teeth, the mechanical linkage comprises a worm gear, the worm gear extends through a passage in the body to engage the teeth of the outer driven portion.

In some embodiments, the inner mandrel portion is shaped to grippingly engage the at least a portion of the tubing hanger received therein.

According to another aspect, there is provided a tubing hanger for a tubing rotator comprising an outer housing defining a longitudinal bore therethrough and having an upper end and a lower end; and a locking swivel rotatably coupled to the outer housing and extending from the upper end of the outer housing; wherein the swivel is movable between: a locked position in which rotation of the outer housing relative to the swivel is restricted; and an unlocked position in which the outer housing is freely rotatable relative to the swivel.

In some embodiments, the tubing hanger further comprises a tubing mandrel extending downward from the outer housing.

In some embodiments, the swivel is tubular, and the swivel, the outer housing, and the tubing mandrel collectively define a fluid passageway through the tubing hanger.

In some embodiments, the swivel is axially movable, relative to the outer housing, between the locked position and the unlocked position.

In some embodiments, the swivel comprises a first interlocking element, the outer housing comprises a second interlocking element, and the first interlocking element releasably engages the second interlocking element to restrict relative rotation of the swivel when the swivel is in the locked position.

In some embodiments, one of the first and second interlocking elements comprises one or more projecting elements, and the other of the first and second interlocking elements comprises one or more recesses or grooves positioned to receive the one or more projecting elements when the swivel is moved to the locked position.

In some embodiments, the outer housing defines a clearance space in the bore of the outer housing that provides clearance for movement of the one or more projecting elements of the swivel during rotation of the swivel in the unlocked position.

In some embodiments, the one or more recesses or grooves open to the clearance area to allow movement of the one or more projecting elements between the clearance area and the one or more recesses or grooves.

In some embodiments, the outer housing is shaped to be landed in a tubing rotator.

In some embodiments, the tubing hanger further comprising a one-way rotational locking mechanism, wherein the tubing mandrel is coupled to the outer housing by the one-way locking mechanism.

In some embodiments, the outer housing comprises concentric first and second portions, and the hanger further comprises a one-way rotational locking mechanism coupling the first and second portions.

According to another aspect, there is provided a bi-directional coupling for coupling a rotational driving member and a driven member, the bi-directional coupling comprising: a first coupling member fixable to the rotational driving member to rotate about a rotational axis, the first coupling member comprising first threads aligned about the rotational axis; a second coupling member fixable to the driven member and comprising second threads, wherein the first coupling member threadingly engages the second coupling member such that relative rotation of the first and second coupling members causes axial movement of the second coupling member relative to the first coupling member; and a first axial stop that limits axial movement of the first coupling member in a first direction relative to the second coupling member when the first coupling member abuts the first axial stop.

In some embodiments, one of the first and second coupling members comprises a generally cylindrical body, and the other of the first and second members defines a hole, the cylindrical body being threadlingly received in the hole.

According to another aspect, there is provided a torque release tubing rotator system comprising: the tubing rotator as described above or below; and the tubing hanger as described above or below received in the tubing rotator.

According to another aspect, there is provided tubing hanger for use in a wellhead with a tubing rotator comprising: an outer portion; an inner portion, wherein at least one of the outer and inner portions is driven; a one-way rotational locking mechanism coupling the outer and inner portions.

Other aspects and features of the present disclosure will become apparent, to those ordinarily skilled in the art, upon review of the following description of the specific embodiments of the disclosure.

BRIEF DESCRIPTION OF THE DRAWINGS

The present disclosure will be better understood having regard to the drawings in which.

DETAILED DESCRIPTION

As noted above, torque that builds up in production tubing (e.g. tubing string) during use of a tubing rotator can cause dangerous, unmanaged and/or unpredictable backspin. It may be desirable to provide mechanisms for managing or controlling backspin of the tubing connected to the tubing hanger. Aspects of the disclosure provide a torque release mechanism for a tubing rotator. Other aspects of the disclosure provide a torque release mechanism for a tubing hanger.

Relative and/or directional terms including "upper," "lower," "above," "below," and the like, are used for ease of description and generally refer to orientations as used in normal operation. Such terms are not intended to limit embodiments to particular orientations of systems, devices, or components thereof.

The terms "coupled to" or "engaged with" as used herein do not necessarily require a direct physical connection between two "coupled" or "engaged" elements. Unless expressly stated otherwise, these terms are to be understood as including indirect couplings between the two elements, possibly with one or more intermediate coupling elements.

Figure 1:
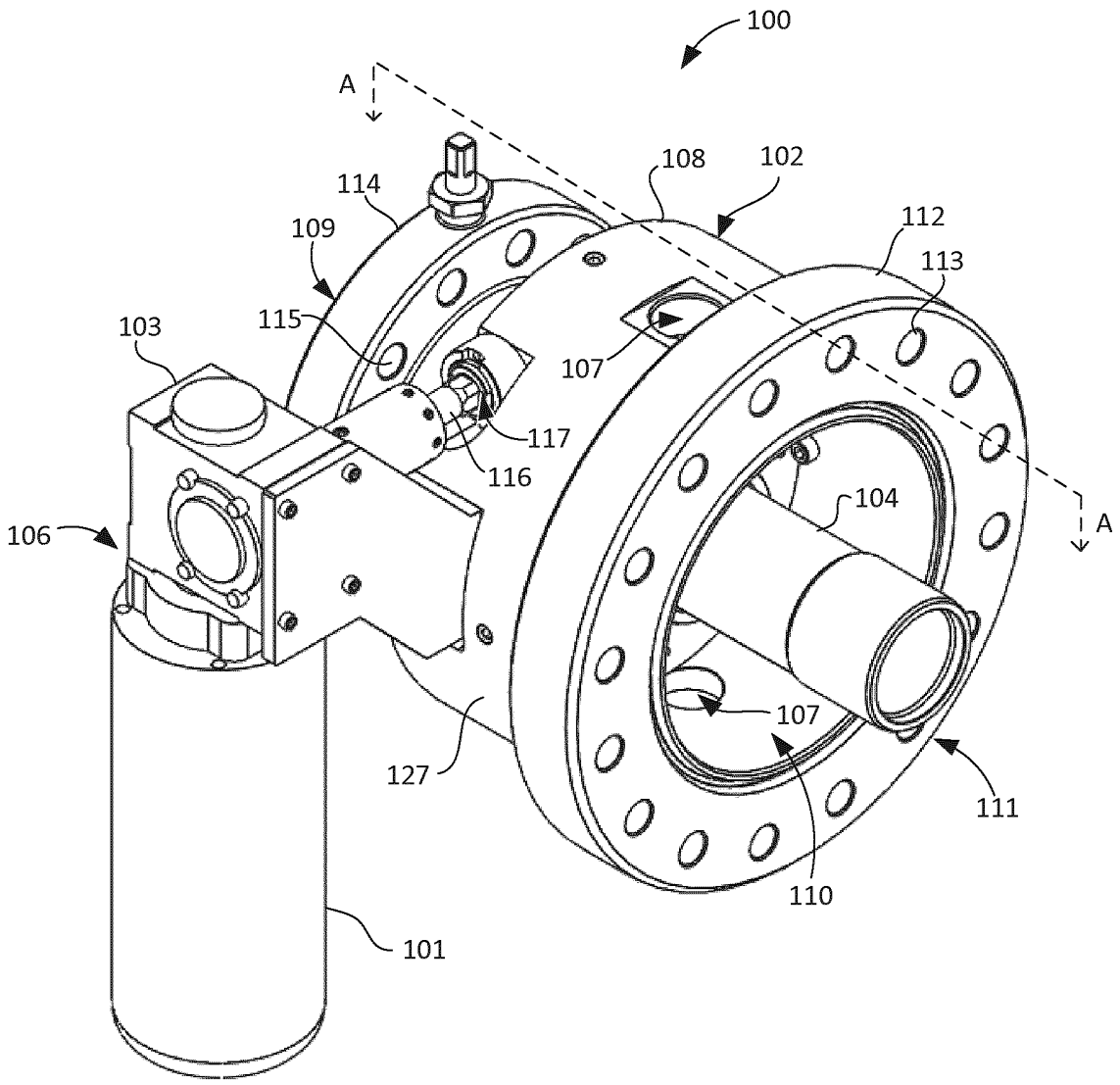
FIG. 1 is a perspective view of a torque release tubing rotator system according to some embodiments.

FIG. 1 is a perspective view of a torque release tubing rotator system 100 according to some embodiments. The torque release tubing rotator system 100 comprises a tubing rotator 102 and a tubing hanger 104 landed therein.

Example, drive system 106 is shown attached to the tubing rotator 102 to drive rotation of the hanger 104. The drive system 106 includes a motor 101, a gear box 103, and a drive shaft 172 (shown in FIGS. 6A to 7B). The motor 101 drives rotation of the drive shaft 172 via the gear box 103. However, embodiments are not limited to any particular method of providing mechanical power to the rotator 102. Any suitable method to mechanically drive the rotator 102 may be used. Furthermore, the tubing rotator 102 may be provided without the drive system 106, with the system 106 (or other drive power source) provided separately.

The tubing rotator comprises a rotator body 108 for mounting on wellhead equipment such as a wellhead or tubing head. The rotator body 108 is generally tubular with a top end 109 and a bottom end 111 and defining bore 110 there through from the top end 109 to the bottom end 111. The body 108 in this embodiment comprises a bottom connector 112 for coupling the body 108 to a wellhead or other wellhead equipment. The body 108 also comprises a top connector 114 to which wellhead equipment such as a Blow Out Preventer (BOP) may be coupled. Embodiments are not limited to any particular wellhead equipment to which the rotator body 108 may be attached by either the top connector 114 or the bottom connector 112, and the torque release tubing rotator system 100 may be used in various applications.

The body 108 is a flange body in this embodiment. In other words, the bottom connector 112 is in the form of an annular bottom flange about periphery of the bore 110 (at the bottom end 111), and the top connector 114 is an annular top flange about the periphery of the bore 110 (at the top end 109). The bottom connector flange 112 in this example includes a plurality of spaced apart holes 113 for receiving mounting hardware (e.g. bolts) to mount the body 108 to the wellhead or other wellhead equipment. The top connector flange 114 also includes a plurality of spaced apart holes 115 for receiving mounting hardware (e.g. bolts) to mount wellhead equipment to the body 108.

Embodiments are not limited to any particular equipment that is attached to the rotator 102, or to any particular method of attachment. The top and bottom connectors 114 and 112 shown may take a different form or be omitted in other embodiments. Similarly, the shape of the body 108 may vary in other embodiments.

FIG. 1 also shows a worm gear 116 connected to the drive system 106 and extending through a passage 117 into the rotator 102. The worm gear is a mechanical linkage between the drive system 106 and the drive mandrel 118 (shown in FIG. 2) of the tubing rotator 102, as explained in more detail below. The worm gear 116 transfers torque from the drive system 106 to the split drive mandrel 118. However, embodiments are not limited to worm gear 116, and other mechanical linkages interconnect the split drive mandrel 118 and the drive system 106 (or other mechanical power source). In still other embodiments, the rotator 102 may be provided without the worm gear 116 or other mechanical linkage, and such components may be provided separately.

In this example, the tubing hanger is substantially received within the split drive mandrel 118. However, in other embodiments, only a portion of the tubing hanger (e.g. a tubing hanger mandrel) may be received in and engaged by the split drive mandrel of the rotator. In some embodiments, the tubing hanger may be mounted at the wellhead, with the drive mandrel of the rotator received over the tubing hanger (rather than the tubing hanger landed in the rotator).

FIG. 1 also shows optional flow lines 107 for line pipes through the side of the rotator 102.

Figure 2:
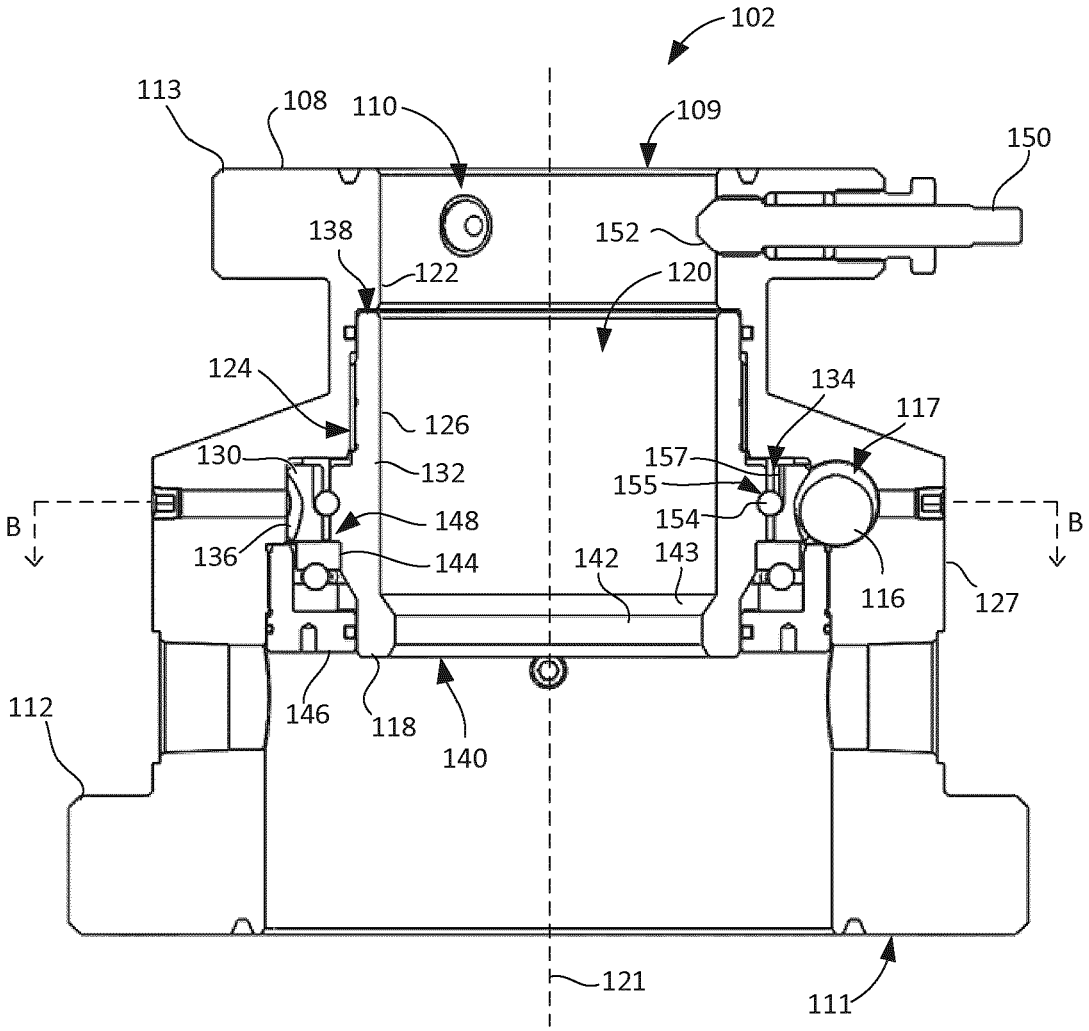
FIG. 2 is a side cross-sectional view of an example tubing rotator of the system of FIG. 1, taken along the line A-A in FIG. 1.

FIG. 2 is a side cross-sectional view of the tubing rotator 102 taken along the line A-A in FIG. 1. The tubing hanger 104 and drive system 106 of the torque release tubing rotator system 100 in FIG. 1 are not shown in FIG. 2.

As shown in FIG. 2, the split drive mandrel 118 mounted within the bore 110 and rotatably coupled to the rotator body 108. The split drive mandrel 118 in this example defines a bore 120 therethough for receiving and the tubing hanger 104 (FIG. 1). The bore 110 of the body 108 and the bore 120 of the split drive mandrel 118 are longitudinally aligned about longitudinal axis 121 in this embodiment. The inner surface 122 of the bore 110 of the rotator body 108 defines a recessed region 124 shaped to receive the split drive mandrel 118 such that the portion of the inner surface 122 above the drive mandrel is generally aligned with the inner surface 126 of the bore 120 of the split drive mandrel 118. However, the shape and configuration of the split drive mandrel 118 may vary in other embodiments.

The split drive mandrel 118 is "split" in that it comprises an outer driven portion 130 and an inner mandrel portion 132. In this embodiment, the inner mandrel portion 132 is generally tubular and the outer driven portion 130 is generally ring-shaped and in the form of an outer gear. The outer and inner portions are concentric and centered about the longitudinal axis 121.

The split drive mandrel 118 further comprises a one-way locking mechanism 134 that couples the outer driven portion 130 and the inner mandrel portion 132. As will be explained in more detail below, the one-way locking mechanism 134 in this embodiment is configured to: engage the inner mandrel portion 132 when the outer driven portion 130 is rotated in a first direction, thereby transferring the rotation of the outer driven portion 130 to the inner mandrel portion 132; and when disengaged, allow the inner mandrel portion 132 to rotate freely with respect to the outer driven portion 130 in a second rotation direction opposite to the first rotation direction.

The first direction may be referred to herein as the "forward" direction. The "forward" direction or forward rotation as used herein means the direction in which the tubing will be rotated during normal operation of the rotator. The term "forward" rotation direction may also refer to the direction of rotation of the worm gear 116 that drives the forward rotation of the split drive mandrel 118. Thus, the second, opposite rotational direction may be referred to as the "reverse" direction.

The outer driven portion 130 is generally in the form of a ring-shaped drive gear having outer teeth 136 about its outer periphery (best shown in FIGS. 3 and 4). The worm gear 116 engages the outer teeth 136 of the outer driven portion 130 such that rotation of the worm gear 116 causes the outer driven portion 130 to rotate. The worm gear passage 117 extends from the outer surface 127 of the body 108 to the bore 110 (shown in FIG. 2). The worm gear passage 117 is substantially horizontal and axially offset from the bore 110 such that the worm gear 116 is generally tangentially aligned with the outer driven portion 130. However, embodiments are not limited to the particular arrangement of the worm gear 116 and passage 117 shown in FIG. 2. Any suitable linkage to couple torque from a drive system 106 or other mechanical power source may be used to drive the split drive mandrel 118.

The example inner mandrel portion 132 in this embodiment is generally tubular and comprises an upper end 138 and a lower end 140, and the bore 120 of the split drive mandrel 118 extends from the upper end 138 to the lower end 140.

Figure 10:
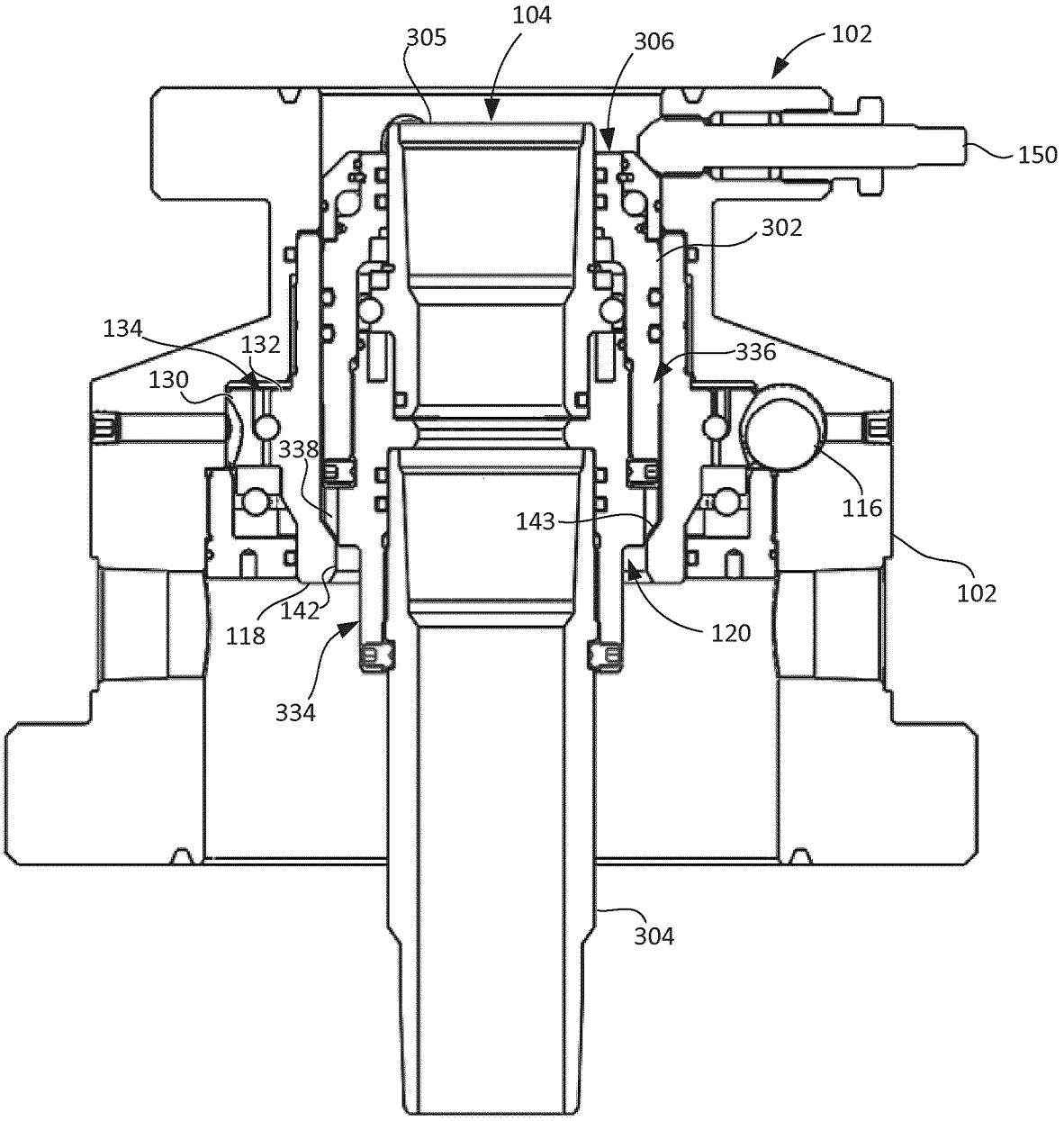
FIG. 10 is a cross-sectional view of the torque release tubing rotator of FIGS. 1 to 8 and the tubing hanger of FIGS. 1 and 8 to 9B landed in the tubing rotator.

The bore 120 of the inner mandrel portion 132 is shaped to grippingly engage the tubing hanger 104. More specifically, the inner surface 126 of the bore 120 in this example defines an inward-extending annular ridge 142 near the lower end 140. The ridge 142 functions as a seat that supports the tubing hanger 104 (FIG. 1) when received in the rotator 102. An upper surface 143 of the ridge 142 is angled and provides a friction-engagement coupling with the hanger 104 (as shown in FIG. 10). The upper surface 143 may be rough and/or comprise knurling or other features to enhance the friction-engagement coupling. However, embodiments are not limited to the particular shape or configuration of the split drive mandrel 118 shown, and embodiments are also not limited to a friction engagement. Other configurations for supporting and grippingly engaging the tubing hanger may be used. For example, rather than a frictional engagement, splines may be used to rotationally couple the split drive mandrel 118 to the hanger 104.

As shown in FIG. 2, the split drive mandrel 118 is axially supported on a thrust bearing 144 mounted within the bore 110 of the body 108. The thrust bearing 144 is mounted on a retaining plate 146 fixed in the bore 110, and the thrust bearing 144 and allows rotation of the split drive mandrel 118 relative to the body 108. The outer driven portion 130 and an outer ridge or collar portion 148 of the inner mandrel portion 132 rest on the thrust bearing 144. Thus, the one-way locking mechanism 134 coupling the outer driven portion 130 and the inner mandrel portion 132 is also positioned over the thrust bearing 144 in this embodiment. However, embodiments are not limited to the inclusion of the thrust bearing 114, and other structures may provide for suitable rotational movement.

The tubing rotator 102 in this embodiment also includes an optional hold down screw 150 that extends through the body 108 near its top end 109. The hold down screw 150 has an end 152 that extends into the bore 110 of the body to provide additional axial support to the hanger 104.

The one-way locking mechanism 134 in this embodiment is in the form of a friction clutch. More particularly, the example one-way locking mechanism 134 is in the form of a one-way bearing clutch. However, other one-way locking mechanism structures may also be used. Another such example is a one-way sprag clutch. Embodiments are not limited to friction locking mechanisms or any particular type of one-way locking mechanism. The one-way locking mechanism 134 of this embodiment comprises: an inner race 155 defined along the periphery of the collar 148 of the inner mandrel portion 132; an outer race 157 formed by the inner surface of the outer driven portion 130; and a plurality of ball bearings 154 between the inner and outer races 155 and 157.

Each race 155 and 157 acts as a guide for the bearings 154, and the bearings 154 are engagement elements that lock or frictionally engage the outer driven portion 130 with the inner mandrel portion 132 for rotation in the forward direction, as explained below. However, other guide structures and engagement elements may be used in place of races and bearings in other embodiments. For example, sprags, rather than bearings may be used.

Additional details and operation of the tubing rotator 102, including the one-way locking mechanism 134, will now be described with reference to FIGS. 3A to 8.

Figure 3A:
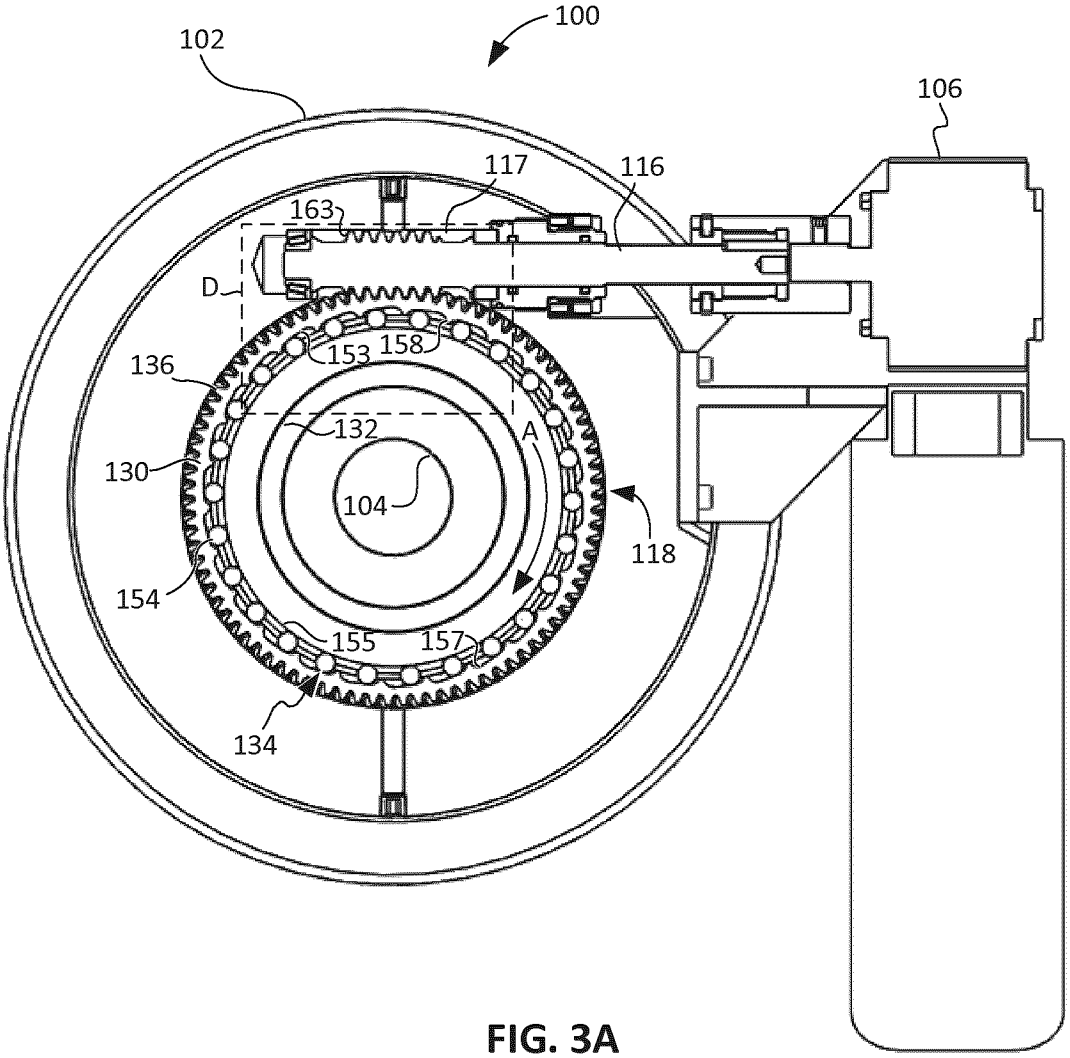
FIG. 3A is a top cross-section view of the torque release tubing rotator system of FIG. 1, showing a one-way locking mechanism in an engaged configuration.

FIG. 3A is a top cross-section view of the torque release tubing rotator system 100 of FIG. 1. The cross section is taken along the line B-B shown in FIG. 2 (but also shows the tubing hanger 104 and drive system 106). FIG. 3A shows the one-way locking mechanism 134 in an engaged position.

*The one-way locking mechanism 134 of this embodiment is a one-way bearing locking mechanism comprising the inner race 155, the outer race 157 and the plurality of ball bearings 154 therebetween. The outer race 157 comprises a plurality of sloped projections 158 (or ramps or tapers). Each bearing 154 is positioned between two adjacent projections 158. The outer race 157 is shaped such that when the outer driven portion 130 (i.e. outer drive gear) is rotated in a first direction indicated by arrow "A" in FIG. 3A, the locking mechanism 134 locks the inner and outer portions 130 and 132 together such that the inner mandrel portion 132 also rotates in the same first direction ("A"), as will be described below in more detail.

Figure 3B:
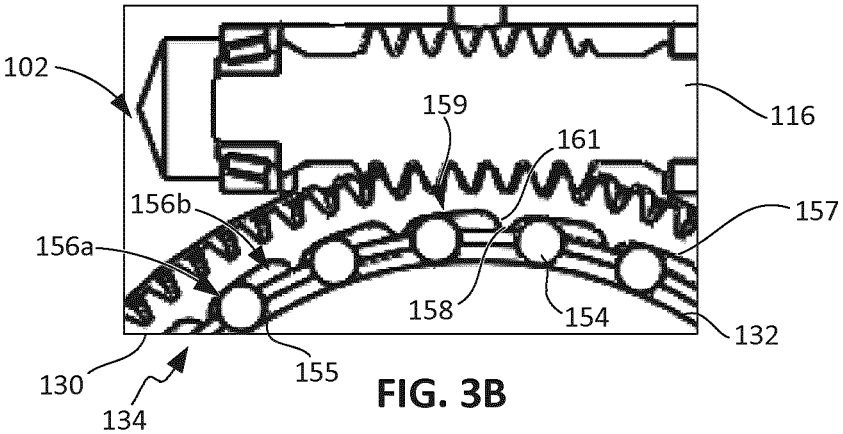
FIG. 3B is an enlarged view of the portion of the torque release tubing rotator system within rectangle "B" in FIG. 3A.
Figure 7A:
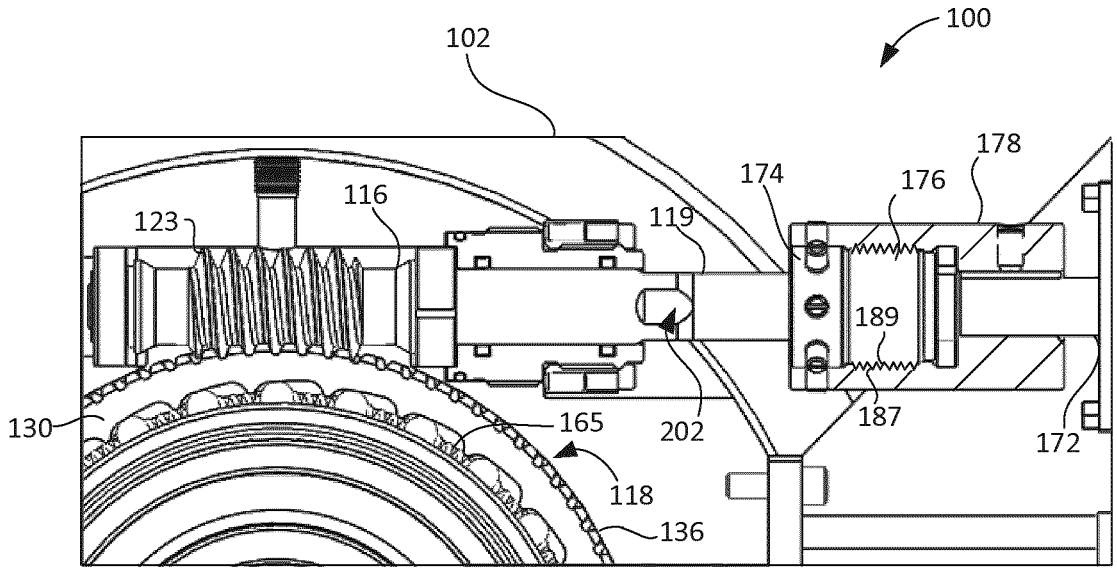
FIGS. 7A and 7B are enlarged, partial cutaway views of the torque release tubing rotator system of FIG. 1.
Figure 7B:
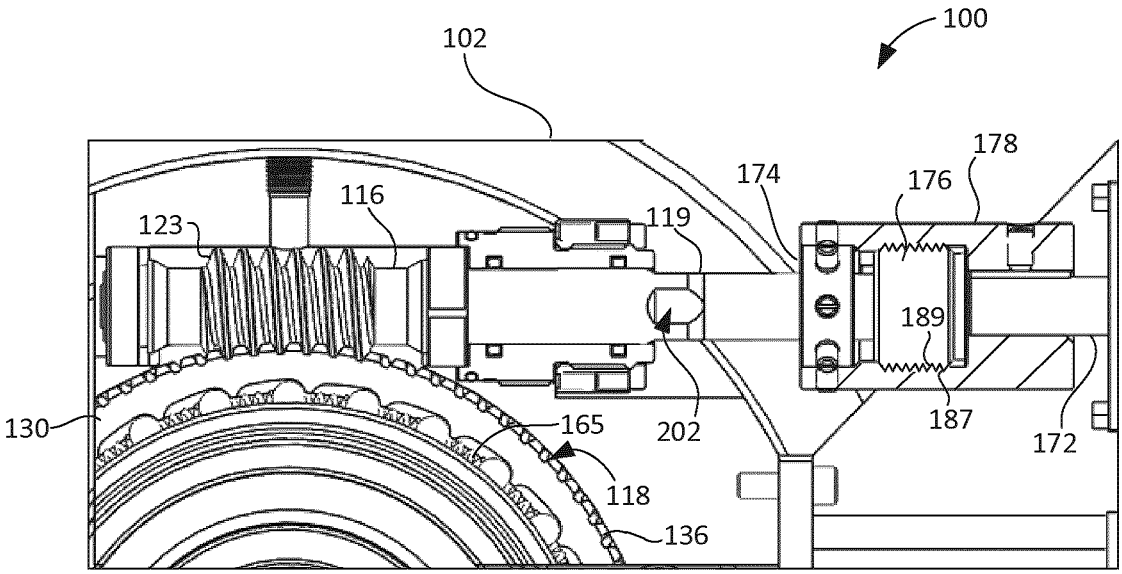

FIG. 3B is an enlarged view of the portion of the tubing rotator 102 within rectangle "B" in FIG. 3A (with the locking mechanism 134 in the engaged configuration). As shown in FIG. 3B, each bearing 154 sits within a space or recess 159 formed between the two adjacent projections 158 of the outer race 157. Thus, the bearings 154 are interspaced with the projections 158. Optionally, the locking mechanism 143 may include spacing means to keep the bearings 154 spaced from each other. For example, in this embodiment, a spacer ring or cage system 163 is included that maintains the spacing of the bearings 154. The cage system 163 is in the form of a ring with spaced apart holes (not visible) therein. Each bearing sits in a corresponding hole. An alternative method of maintaining spacing between the bearings 154 is shown in FIGS. 7A and 7B (in which springs 165 are used rather than the cage system 163).

Each recess 159 between an adjacent pair of projections 158 is defined by a tapered curve 153 that extends between the pair of projections 158. The tapered curve 153 tapers from a first projection 158 to form a reduced clearance side **156*a* of the recess 159 and continues to taper to form an increased clearance side 156*b* near the second of the projections 158. The reduced clearance space 156*a* is positioned to engage the bearings 154 when the outer driven portion 130 of the split drive mandrel 118 is driven in the forward direction (arrow "A" in FIG. 3A). The reduced clearance side 156*a* does not provide sufficient clearance to allow free movement of the bearing 154 (i.e. tapers to pinch the bearing 154 between the outer race 157 and the inner race 155). The increased clearance side 156*b* is shaped to provide sufficient space for the bearing 154 to rotate. In this example, the increased clearance side 156*b* is curved to match the outer circumference of the bearing 154**.

Thus, when the outer driven portion 130 rotates clockwise, the bearings 154 are pinched between the reduced clearance side of the corresponding projections 158 and the inner race 155. This pinching creates friction that, collectively, creates a friction engagement between the outer and inner portions 130 and 132 of the split drive mandrel 118. Thus, the one-way locking mechanism 134 engages to cause outer and inner portions 130 and 132 to rotate together when the outer driven portion 130 is rotated in the first (forward) direction by the worm gear 116.

Embodiments are not limited to a tapered curve, and any tapered, asymmetrical recess shape that provides a gripping engagement of the bearings (or other engagement elements) for the forward direction of rotation may be used. For example, straight ramp surfaces or other tapering surface shapes may provide similar functionality.

Figure 4A:
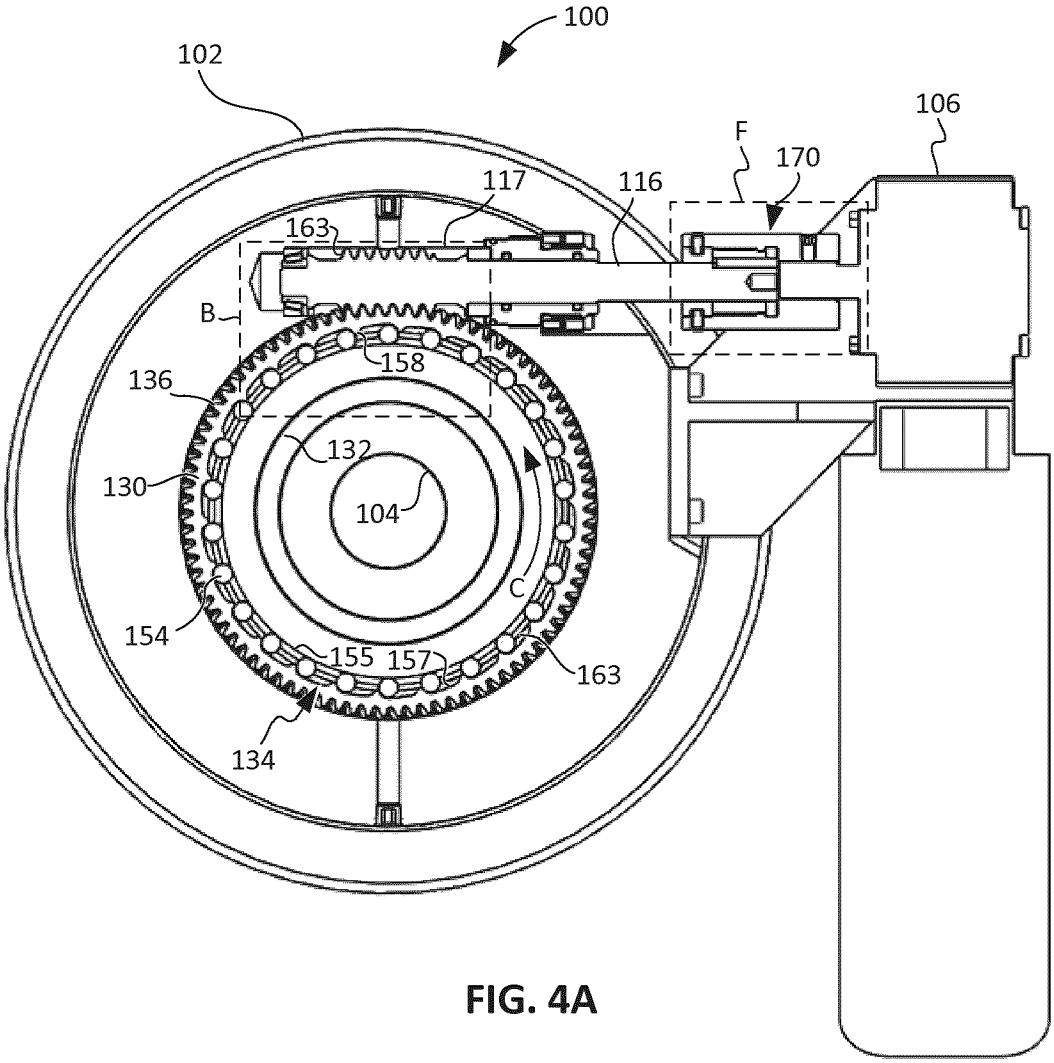
FIG. 4A is the same cross-section view as FIG. 3A, but showing the one-way locking mechanism in an unengaged configuration.

FIG. 4A is the same cross-section view as FIG. 3A, but showing the one-way locking mechanism 134 in an unengaged configuration. The friction engagement (i.e. locking) of the bearings 154 in the inner and outer races 155 and 157 may be released when the outer driven portion 130 is no longer being driven in the first direction (arrow "A" in FIG. 3A). That is, in the absence of force caused by driving the outer driven portion 130, the bearings 154 may no longer form a friction engagement between the outer and inner portions 130 and 132 of the split drive mandrel 118. Alternatively, the outer driven portion 130 may be rotated a small amount in the reverse direction to release the one-way locking mechanism 134, as illustrated in FIG. 4A. When unengaged, the bearings 154 move into the increased clearance side 156*b* of the recesses 159 between projections 158, and the bearings 154 may, thus, rotate freely. Therefore, the one-way locking mechanism 134 allows free rotation of the inner mandrel portion 132 relative to the outer driven portion 130 in a second, opposite direction shown by the arrow "C" in FIG. 4A. Thus, the inner mandrel portion 132 and the tubing hanger 104 landed therein may rotate backward to release torque trapped in the tubing (not shown).

Figure 4B:
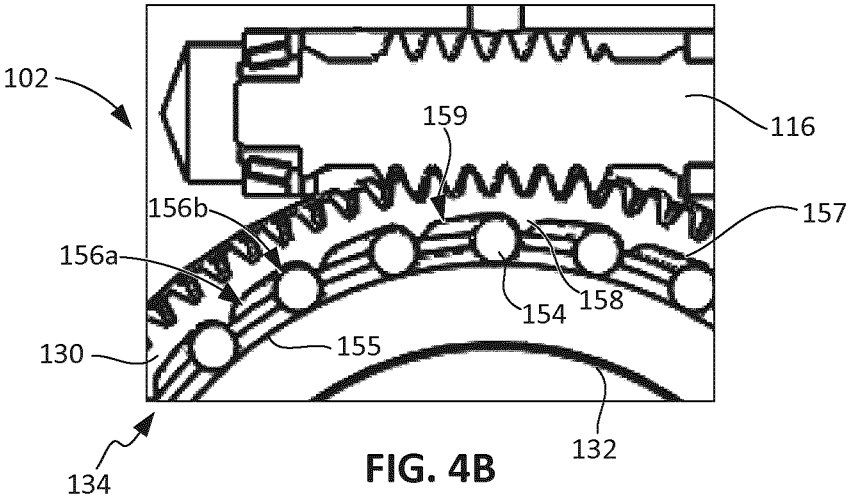
FIG. 4B is an enlarged view of the portion of the torque release tubing rotator system within rectangle "D" in FIG. 4A.

FIG. 4B is an enlarged view of the portion of the tubing rotator 102 within rectangle "D" in FIG. 4A (with the locking mechanism 134 in the engaged configuration). As shown in FIG. 4B, the bearings are positioned in the increased clearance sides 156*b* of the recesses 159 such that the inner mandrel portion 132 may rotate with respect to the outer driven portion 130.

Figure 5A:
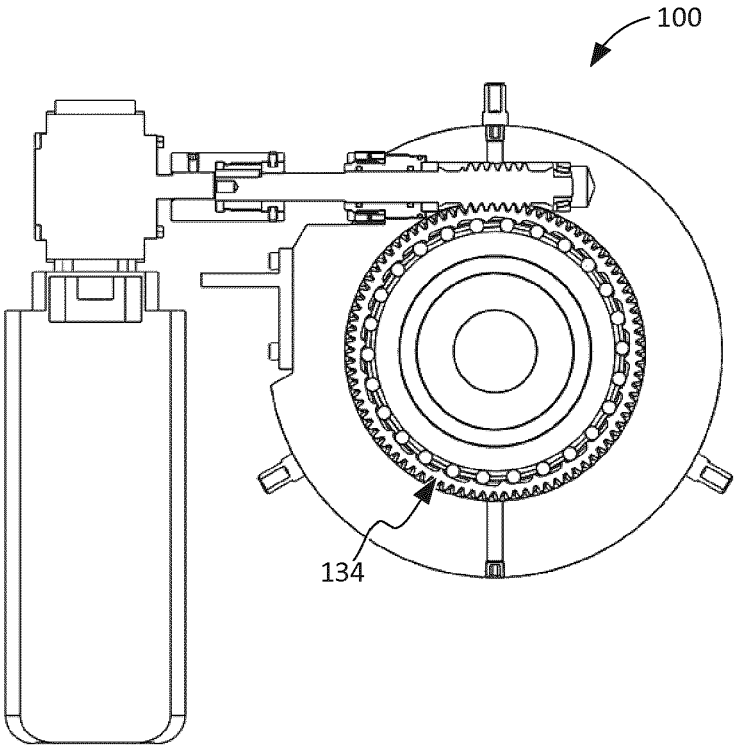
FIGS. 5A and 5B are bottom cross-sectional views of the torque release tubing rotator system of FIG. 1.
Figure 5B:
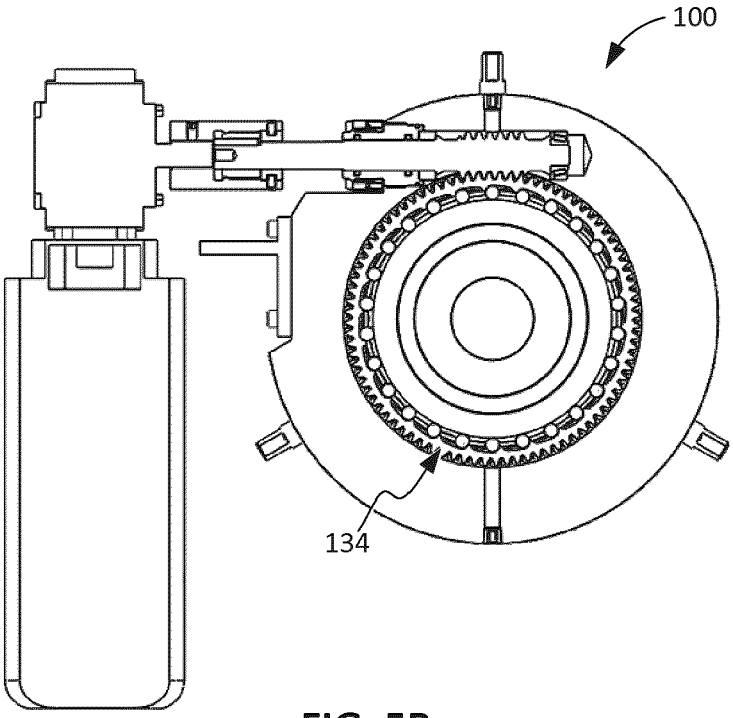

FIGS. 5A and 5B are bottom cross-sectional views of the torque release tubing rotator system 100. The cross-section is taken at the same position as FIGS. 3A and 4A. FIG. 5A shows the one-way locking mechanism 134 in the engaged position of FIG. 3A. FIG. 5B shows the one-way locking mechanism 134 in the unengaged position of FIG. 4A.

Typically, drive systems system for tubing rotators only drive rotation in a single direction (referred to herein as "forward" direction) and may not allow rotation in the reverse direction. Thus, in conventional tubing rotators, the worm may not be rotatable in the reverse direction. In some cases, stopping the driving of the rotation may, by itself, not release the locking mechanism 134 to release trapped torque in the tubing. For example, tension and/or friction in the locking mechanism 134 may initially hold the bearings 154 in the locked position. In such circumstances, it may be desirable to manually back off the outer driven portion 130 to release the locking mechanism 134 and initiate the torque release.

Turning again to FIG. 3A, in some embodiments, the torque release tubing rotator system 100 further includes a bi-directional coupling 170 between the worm gear 116 and the drive system 106. The bi-directional coupling 170 transfers torque from the drive system 106 to the worm gear 116, which, in turn, drives the forward rotation of the outer driven portion 130 that is transferred to the inner mandrel portion 132 by the one-way locking mechanism 134. The bi-directional coupling 170 also allows the worm gear 116 to rotate in the reverse direction to release the one-way locking mechanism 134, if needed, and allow torque in the tubing to be released. For example, the bi-directional coupling 170 in this example allows the worm gear 116 to be manually rotated in the reverse direction, if needed. The bi-directional coupling 170 provides a secondary means for releasing the one-way locking mechanism 134, and may optionally be used to confirm or ensure that the torque is released.

The example bi-directional coupling 170 will now be described in more detail with reference to FIGS. 6A to 7B. However, it is to be understood that embodiments are not limited to the particular bi-directional coupling 170 shown in the drawings. For example, a bi-directional coupling may instead comprise a dual-rotation coupling, a dual-threaded coupling, or any other suitable coupling. Other mechanisms and methods for allowing the outer driven portion 130 of the split drive mandrel 118 to be reversed or backed off may also be used.

Figure 6A:
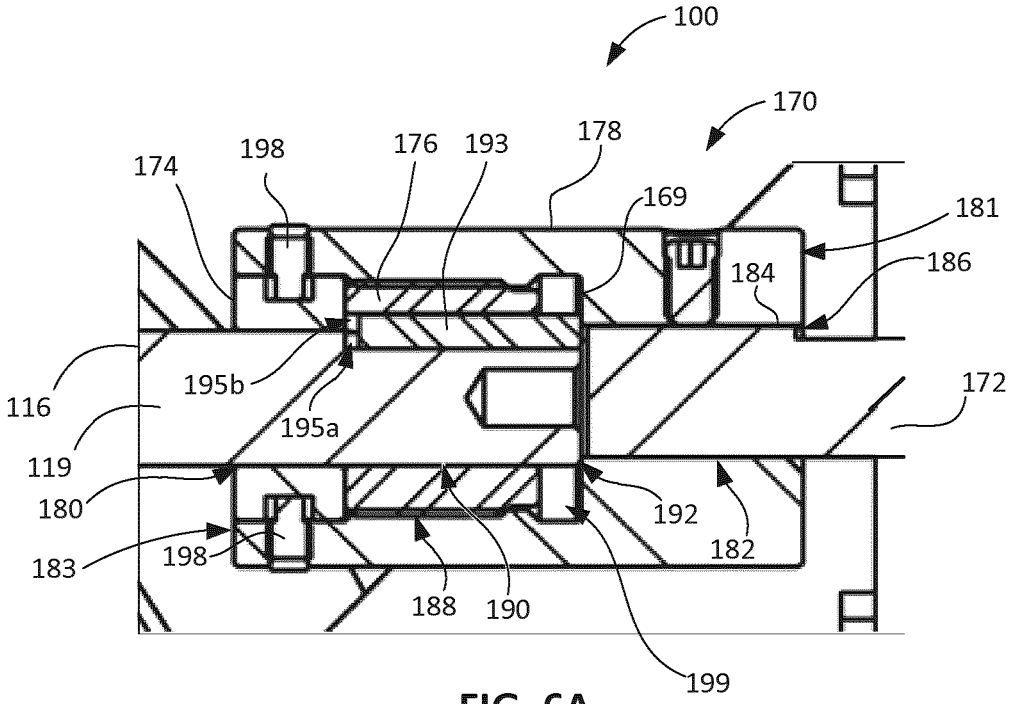
FIGS. 6A and 6B are enlarged cross-sectional views of the portion of the torque release tubing rotator system within rectangle "F" in FIG. 3A.
Figure 6B:
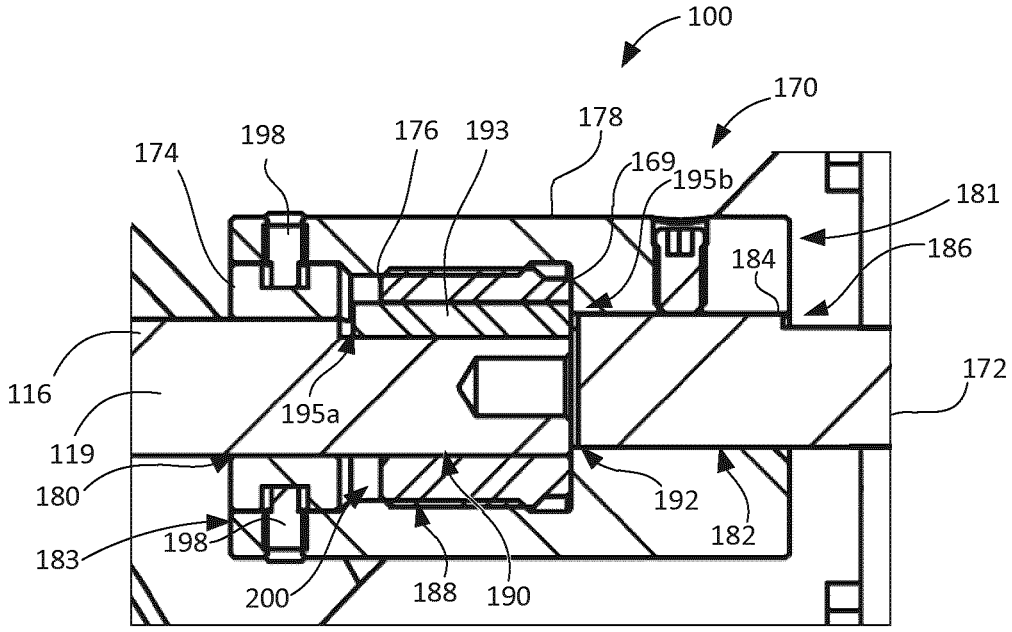

FIGS. 6A and 6B are enlarged cross-sectional views of the portion of the torque release tubing rotator system 100 within rectangle "F" in FIG. 3A. The bi-directional coupling 170 interconnects the worm gear 116 and the drive axel 172 of the drive system 106. The bi-directional coupling 170 couples forward torque from the drive axel 172 to the worm gear 116, but also allows the worm gear 116 to be rotated in the reverse direction. In this example, the bi-directional coupling 170 includes a shear collar 174, an inner drive release member 176, and a drive coupling 178. The worm gear 116 comprises a worm shaft 119 and gear thread 123 on the shaft 119 that engage the teeth 136 of the outer driven portion 130.

The drive coupling 178 is rotationally locked with the drive axel 172. More particularly, drive coupling 178 defines a hole 180 therethrough from a first end 181 to a second end 183 of the drive coupling 178. The hole 180 includes a first portion 182 that receives an end portion of the drive axel 172 through the first end 181 of the drive coupling 178. The drive axel 172 includes a raised key 184 extending lengthwise that mates with a groove 186 defined in the inner surface of the hole 180. Thus, rotation of the drive axel 172 is transferred to the drive coupling 178 by the key 184 in the groove 186.

The hole 180 through the drive coupling 178 includes a second, wider portion 188 that receives, through the second end 183, an end portion 192 of the worm shaft 119, the inner drive release member 176 and the shear collar 174. The inner drive release member 176 is a generally cylindrical body that is threadingly received in the hole 180.

The inner drive release member 176 has a limited range of axial movement relative to the drive coupling 178. A washer-shaped face 169 is formed at the transition between the narrower first portion 182 and the wider second portion 188. The face 169 faces the inner drive release member 176 and acts as an abutment or axial stop that limits axial movement of the inner drive release member 176 in the direction toward the first end 181 of the drive coupling 178. The shear collar 174 acts as a stop limiting axial movement of the inner drive release member 176 in the direction toward the second end 183 of the drive coupling 178.

The inner drive release member 176 is rotationally locked with the worm gear 116. More particularly, inner drive release member 176 defines a hole 190 therethrough that receives the end portion 192 of the worm shaft 119. The end portion 192 and the inner surface of the hole 190 define aligned grooves 195*a* and 195*b* respectfully, and an elongate key 193 is received in the grooves 195*a* and 195*b* and rotationally locks the inner drive release member 176 with the worm gear 116. The key 193 is generally an elongated beam with a rectangular profile in this embodiment. The key 193 is longer than the inner drive release member 176, and the inner drive release member 176 can slide, axially, a limited distance relative to the key 193 and worm shaft 119.

The shear collar 174 is received over the shaft 119 and in a second end 183 of the drive coupling. The shear collar 174 is fixed to the drive coupling 178 by a plurality of shear pins 198. The inner drive release member 176 is positioned inward of the shear collar 174 within the hole 180. The second portion 188 of the hole 180 is shaped to provide clearance for a small amount of axial movement of the inner drive release member 176. The inner drive release member 176 includes outer threads 187 (illustrated in FIGS. 7A and 7B) that mate with inner threads 189 (illustrated in FIGS. 7A and 7B) of the drive coupling 178. The threads 187 and 189 are aligned about the rotational axis (i.e. longitudinal axis) of the drive shaft. The threads 187 and 189 in FIGS. 7A and 7B are shown by way of example and do not limit embodiments to a particular specifications or dimensions of the thread.

Rotation of the drive coupling 178 relative to the inner drive release member 176 causes axial movement of the inner drive release member 176 relative to the drive coupling 178. Rotation of the drive coupling 178 in the "forward" direction (as driven by the drive system 106) causes the inner drive release member 176 to move toward the shear collar 174 until it abuts the shear collar 174. The shear collar 174, thus, acts as a first or forward axial stop.

FIG. 6A shows the inner drive release member 176 in a fully "forward" position (abutting the shear collar 174). At that point, the inner drive release member 176 cannot move further in the forward axial direction, and, thus, the inner drive release member 176 is rotationally locked with the split drive mandrel 118 as the split drive mandrel 118 continues to rotate. Torque is thereby transferred through the inner drive release member 176 to the worm shaft 119. In this position, a space 199 is provided "behind" the inner drive release member 176.

When the drive system 106 is off or in neutral, the worm gear 116 may be rotated manually (e.g. using a wrench or other gripping tool on the worm shaft 119) or automatically in the reverse direction. In some embodiments, the drive system may be configured to drive both reverse and forward rotation. The reverse rotation is transferred to the inner drive release member 176, which is free to rotate in that reverse direction relative to the drive coupling 178. The reverse rotation moves the inner drive release member 176 back away from the shear collar 174.

FIG. 6B shows the inner drive release member 176 in a fully "rearward" position abutting the face 169. In the fully "rearward" position, space 200 is provided between the inner drive release member 176 and the shear collar 174. The drive axel 172 may remain stationary.

FIGS. 7A and 7B are partial cutaway views of the torque release tubing rotator system 100, showing the worm gear 116 coupled between the drive axel 172 and the outer driven portion 130 of the split drive mandrel 118. The worm gear 116, the shear collar 174 and the inner drive release member 176 are not cross-sectioned or cutaway in FIGS. 7A and 7B. The drive coupling 178 is cutaway to show the inner drive release member 176. FIG. 7A shows the inner drive release member 176 in a fully "forward" position of FIG. 6A, with the one-way locking mechanism 134 engaged. FIG. 7B shows the inner drive release member 176 in a fully "rearward" position of FIG. 6B, with the outer driven portion 130 backed off to disengage the one-way locking mechanism 134.

The drive coupling 178 is a first coupling member that is fixed to a rotational driving member (i.e. drive axel 172 in this embodiment) for rotation about an axis of rotation (i.e. the longitudinal axis of the drive member). The inner drive release member 176 is a second coupling member that is fixed to the driven member (i.e. worm shaft 119 in this embodiment) and threadingly engaged with the first coupling member. However, embodiments are not limited to the shape or configuration of the inner drive release member 176 and drive coupling 178 in this embodiment. Any first and second threadingly engaged members may be used where relative rotation of the first and second members causes relative axial movement of the first and second members. The shear collar 174 and face 169 are only examples of stopping means that may limit axial movement of the inner drive release member 176. Other means of providing a limited axial range of motion may be used (e.g. pins or other mechanical stop mechanisms).

As also shown in FIGS. 7A and 7B, the worm shaft 119 is provided with two sets of opposing flats 202 to provide a surface for a wrench or other gripping tool to grip to grip the worm shaft 119 to rotate the worm gear 116 in the reverse direction to back off the outer driven portion 130. The springs 165 that maintain spacing between the bearings 154 of the one-way locking mechanism 134 in this embodiment are also shown in FIGS. 7A and 7B.

The example tubing hanger 104 of the torque release tubing rotator system 100 will now be described in more detail with reference to FIGS. 8 to 15. The tubing hanger 104 comprises another torque release mechanism and may be used in conjunction with the torque release tubing rotator 102 described above with respect to FIGS. 1 to 7B. However, the tubing hanger 104 is not limited to use with the particular tubing rotator 102 described above. The hanger 104, may be used with a rotator that does not include torque release feature such as a split drive mandrel. Similarly, the example tubing rotator 102 shown in the drawings is not limited to the particular tubing hanger 104 shown in FIGS. 8 to 15.

Figure 8:
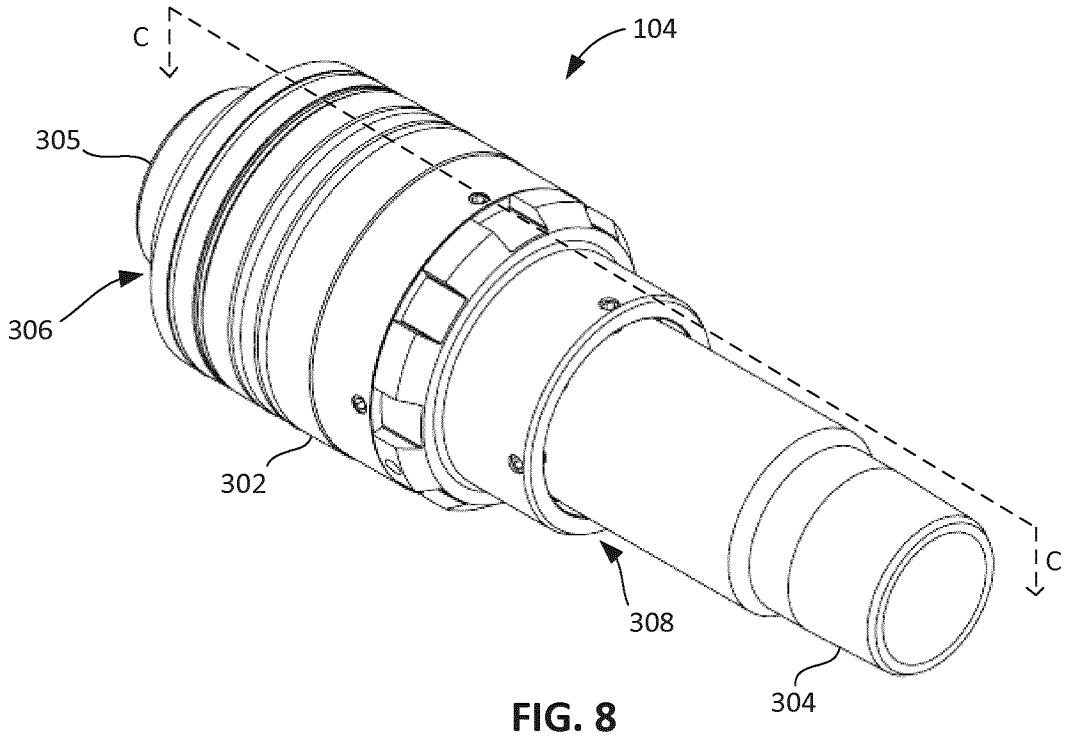
FIG. 8 is a perspective view of a torque release tubing hanger according to some embodiments.

FIG. 8 is a perspective view of the hanger 104. The tubing hanger 104 comprises a tubular outer housing 302, a tubing mandrel 304 suspended from the outer housing 302, and a locking swivel 305. The outer housing 302 has an upper housing end 306 and a lower housing end 308, and the tubing mandrel 304 is partially received through, and extends from, the lower housing end 308.

The tubing mandrel 304 in this embodiment may be threaded for a quick release from the housing 302 so that the remainder of the tubing hanger 104 may simply be removed for service to the production tubing by pipe wrenches, for example. Removal of the outer housing 302 from the tubing mandrel 304 may be performed manually and not require a powered mechanical torque unit (e.g. power tongs) to make and break the connection.

The locking swivel 305 in this embodiment is partially or substantially contained in the outer housing 302 but extends upward from the upper housing end 306. The swivel 305 has a locked configuration in which the swivel 305 is rotationally locked with the outer housing 302 and the tubing mandrel 304, and an unlocked configuration in which the swivel 305 is freely rotatable relative to the outer housing 302 and the tubing mandrel 304. Typically, the swivel 305 will be in the locked configuration during tubing rotation. When desired, the swivel 305 may be moved to the unlocked position to allow the hanger 104 to rotate relative to the swivel 305 to release torque trapped in the production tubing (not shown).

Figure 9A:
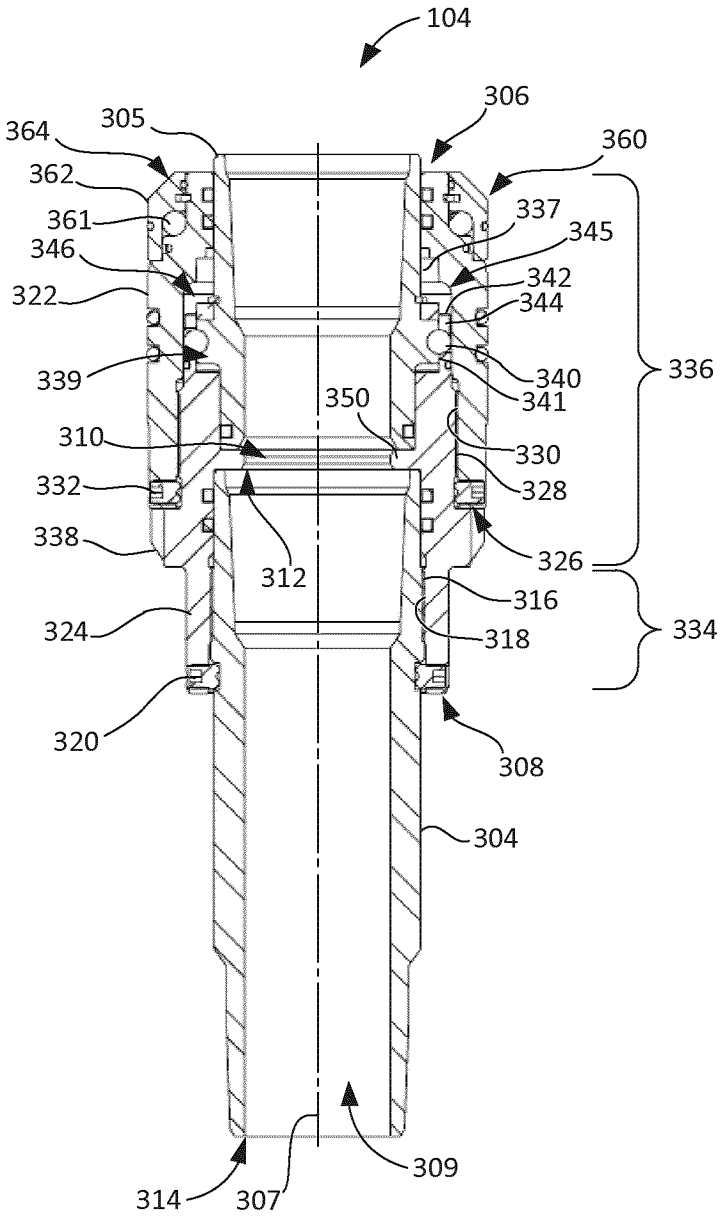
FIG. 9A is a cross-sectional view of the torque release tubing hanger taken along the line C-C in FIG. 8 and showing the swivel in a locked configuration.
Figure 9B:
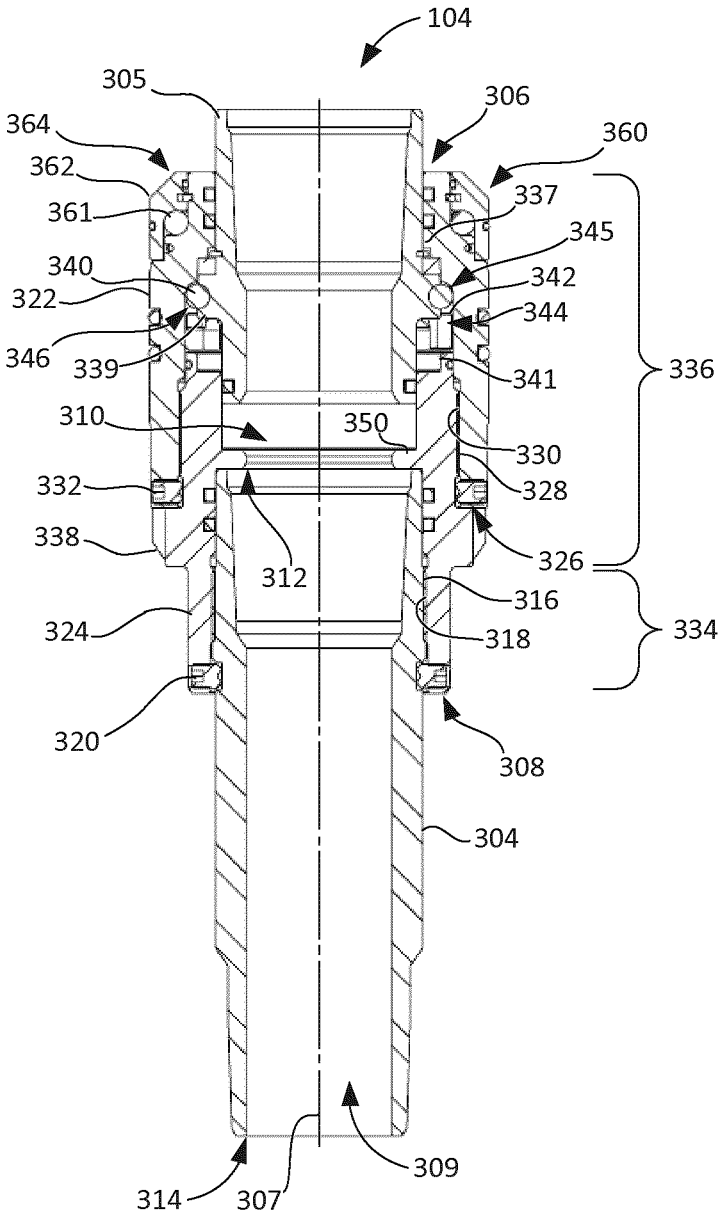
FIG. 9B is another cross-sectional view of the torque release tubing hanger taken along the same line C-C in FIG. 8, but showing the swivel in an unlocked configuration.

FIGS. 9A and 9B are cross-sectional views of the tubing hanger 104 taken along the line C-C in FIG. 8. FIG. 9A shows the swivel in the locked configuration, and FIG. 9B shows the swivel 305 in the unlocked configuration.

The outer housing 302 in this embodiment is generally tubular and defines a longitudinal bore 310 therethrough from the upper housing end 306 to the lower housing end 308. The tubing mandrel 304 has an upper mandrel end 312 and a lower mandrel end 314. The upper mandrel end 312 is received in the bore 310 of the outer housing 302 through the lower housing end 308. The tubing mandrel 304 may be secured to the outer housing 302 in any suitable manner. In this embodiment, the upper portion of the tubing mandrel 304 (that is received in the bore 310) has outer threads (not shown) on its outer surface 316 that mate with inner threads (not shown) on the inner surface 318 of the bore 310. Locking screws 320 or other securing hardware may fix the position of the tubing mandrel 304 relative to the outer housing 302.

The production tubing to be rotated (not shown) may be connected to the lower mandrel end 314. For example, the lower mandrel end 314 may be threaded for a threaded coupling to the production tubing. In this example embodiment, the outer housing 302 comprises an upper housing piece 322 and a lower housing piece 324, which are secured together. However in other embodiments the upper housing piece 322 and a lower housing piece 324 could instead be formed as a unitary body, or alternatively may comprise more components connected together. Furthermore, rather than being separate components that are connected, the tubing mandrel 304 may also be integrated with the outer housing 302 as a unitary body in other embodiments (with the tubing mandrel extending downward).

The lower housing piece 324 in this embodiment is partially received through a lower end 326 of the upper housing piece 322. The tubing mandrel 304 is suspended from the lower housing portion 324 such that it extends downward from the outer housing 302. Thus, the lower housing piece 324 is positioned intermediate the upper housing piece 322 and the tubing mandrel 304.

The lower housing piece 324 of the outer housing 302 may be secured to the upper piece 322 in any suitable manner. For example, the lower housing piece 324 may have outer threads (not shown) on its outer surface 328 that mate with inner threads (not shown) on the inner surface 330 of the upper housing piece 322. Locking screws 332 or other securing hardware may fix the position of the upper housing piece 322 relative to the lower housing piece 324.

The outer housing 302 is shaped to be received and landed within the tubing rotator 102 (FIG. 1). More specifically, the outer housing 302 has a lower region 334 and an upper region 336. The lower region comprises a portion of the lower housing piece 324 and has a smaller outer diameter than the upper region 336, which is formed by the upper housing piece 322 and the remainder of the lower housing piece 324. An angled annular waist 338 is formed at the transition between the narrower lower region 334 and wider upper region 336. The annular waist 338 is part of the lower housing piece 324 in this example.

FIG. 10 is a cross-sectional view of the tubing rotator 102 and the tubing hanger 104 landed in the tubing rotator 102. As shown, wide upper region 336 of the hanger 104 is received in the bore 120 of the split drive mandrel 118. As shown, the annular waist 338 is shaped complementary to the upper surface 143 of the inner annular ridge 142 of the split drive mandrel 118. The annular ridge 142, thus, acts as a seat that supports the hanger 104 and prevents further downward movement of the hanger 104. The hold down screw 150 is positioned to abut the upper end 306 of the outer housing 302 to prevent upward movement of the hanger 104. The narrow lower region 334 of the outer housing 302 extends downward from the split drive mandrel 118.

The hanger 104 includes an upper annular bushing 360 that comprises bearings 361 and an upper race portion 362. The upper race portion 362 also forms an upper annular shoulder 364 of the outer housing 302 that abuts the hold down screw 150. The upper race portion 362 is rotatable relative to the remainder of the tubing hanger 104. Thus, even if the hold down screw 150 exerts pressure on the upper race portion 362, the tubing hanger 104 may still freely rotate relative to the hold down screw 150.

Turning again to FIGS. 9A and 9B, the locking swivel 305 is generally tubular and is rotatably coupled to the outer housing 302 within the bore 310. The swivel extends through the upper end 306 of the outer housing 302. The swivel 305, the outer housing 302 and the tubing mandrel 304 are axially aligned (about longitudinal axis 307) to provide a fluid passageway 309 through the hanger 104.

The locking swivel 305 includes a collar portion 339 that projects radially from an outer face 337 of the swivel. A plurality of bearings 340 are partially embedded in an outer face 341 of the collar portion 339. Other outwardly projecting elements, other than bearings 340 may be used in other embodiments. The bearings 340 partially extend outward (i.e. radially away from the longitudinal axis 307) from the outer face 341 of the collar portion 339. The bearings 340 are generally spaced apart in a ring formation about the swivel 305.

The bearings 340, collectively, form a first interlocking element, as explained below. The upper housing piece 322 comprises an inner wall 342 that defines spaced apart grooves 344 collectively arranged in a ring formation. The spacing of the grooves 344 matches the spacing and of the bearings 340, and the grooves are position to receive the bearings 340 when the swivel 305 is moved to the locked position. More specifically, the grooves 344 receive the portions of the bearings 340 extending from the periphery of the swivel 305. The grooves 344 restrict rotation of the swivel 305 when the bearings 340 are received therein. In this example, the grooves 344 include at least one vertical portion (as explained in more detail below) that, thus, restricts horizontal movement of the bearings 340 relative to the outer housing 302. The grooves 344 collectively form a second interlocking element that engages the first interlocking element (the bearings 340).

A clearance space 346 between the swivel 305 and outer housing 302 is provided above the grooves 344 of the outer housing 302. The clearance space 346 provides clearance for axial movement of the collar portion 339 between the lower (locked) position and the raised (unlocked) position. The clearance space 346 also provides clearance for rotation of the bearings 340 about the longitudinal axis 307 when the swivel is in the raised (unlocked) position. In this embodiment, the inner surface 330 of the upper housing piece 322 forms an upper annular race 345 in which the bearings 340 may travel when the swivel rotates. The grooves 344 open to the clearance space 346 and allow upward movement of the swivel 305 to release the bearings 340 from the grooves 344.

In FIG. 9A, the swivel 305 is in a lower, locked configuration. In the locked configuration, the bearings 340 of the swivel 305 are received in the grooves 344. In this position, the swivel 305 is stopped from any substantial rotational movement relative to the outer housing 302 and tubing mandrel 304. The lower housing piece 324 in this embodiment includes an annular bushing ridge 350 that extends inward within the bore 310. The bushing ridge 350 acts as lower stop for the swivel 305 to prevent further downward axial movement when the swivel 305 is in the lower (locked) position. The bushing ridge 350 also maintains a small separation between the tubing mandrel 304 (which abuts the underside of the ridge 350 in this embodiment) and the swivel 305.

In FIG. 9B, the swivel 305 is in a raised, unlocked position in which the bearings 340 are lifted out of the grooves 344. In the unlocked position, the bearings 340 are not restricted by the grooves 344. Thus, the outer housing 302 and tubing mandrel 304 are free to rotate with respect to the swivel 305. That is, the hanger 104 may freely backspin relative to the swivel 305, to release torque in the production tubing, when the swivel 305 is unlocked.

Figure 11:
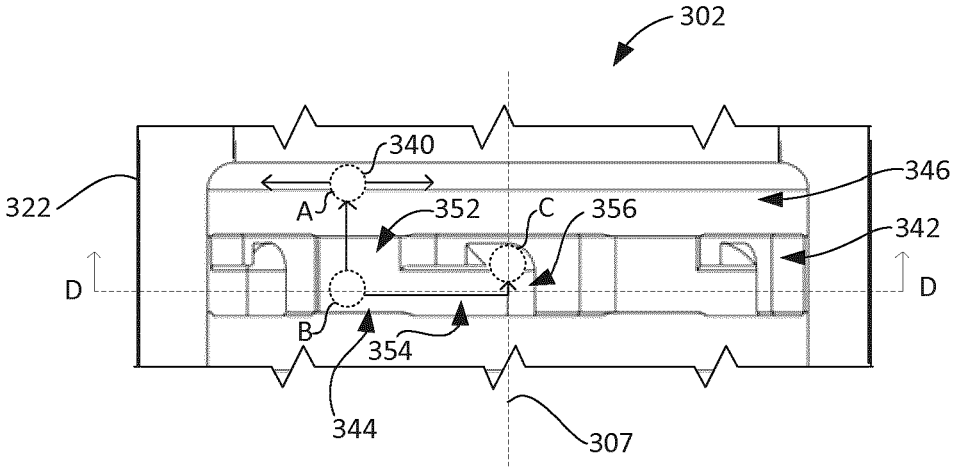
FIG. 11 is an enlarged partial side view of an outer housing of the torque release tubing hanger of FIGS. 1 and 8 to 9B.
Figure 12A:
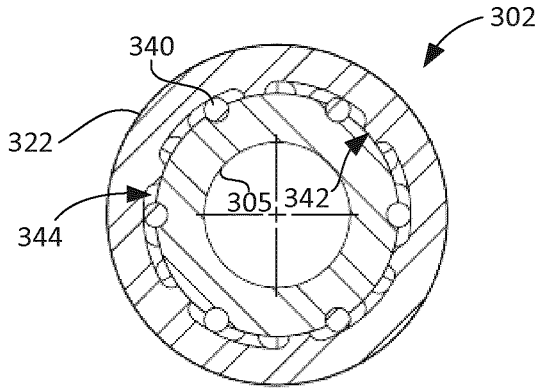
FIGS. 12A and 12B are bottom cross-sectional views of the torque release tubing hanger taken along the line D-D in FIG. 11.
Figure 12B:
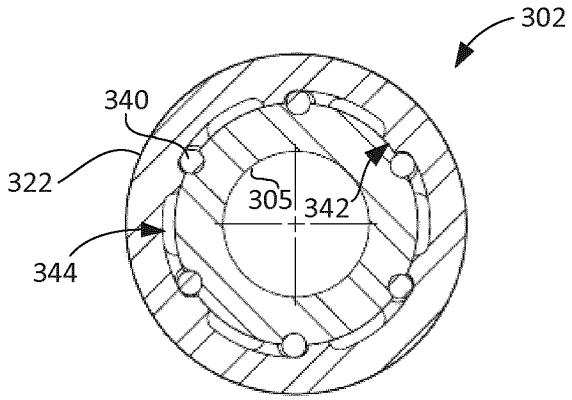

FIGS. 11 to 12B show additional details of the example interlocking elements of the swivel 305 and outer housing 302 in this embodiment.

FIG. 11 is an enlarged partial side view of the outer housing 302. The clearance space 346 and the grooves 344 in the inner wall 342 of the upper housing piece 322 are shown visible through the housing 302 for illustrative purposes, although they would normally be hidden from view. One bearing 340 shown in stippled lines at positions "A", "B" and "C" to illustrate possible movement of the bearing 340. As shown, the groove include a first vertical portion 352 that opens to the clearance space 346, a lower horizontal portion 354, and a second vertical portion 356 that does not extend to reach the clearance space 346. The horizontal portion 354 connects the first and second vertical portions 352 and 356.

In unlocked position "A" of the bearing 340 shown in FIG. 11, the bearing 340 is free to move horizontally within the clearance space 346 about the longitudinal axis 307. Thus, the swivel 305 (FIGS. 9A and 9B) to which the bearing 340 is attached may freely rotate relative to the outer housing 302, and vice versa.

The bearing 340 may extend downward into the groove 344 to position "B". From position "B" the bearing may move horizontally and slightly upward to "locked" position "C". Thus, by lowering the swivel 305 and rotating it a small amount, the bearings 340 may be moved from position "A" to position "C" to lock the swivel 305. The locked position of the swivel 305 in this embodiment provide may restrict both rotational and axial relative movement of the swivel 305. To release the bearings 340 from the locked position "C", the swivel may be lowered, rotated (in the opposite direction), and lifted again to move the bearings to position "A".

FIGS. 12A and 12B are bottom cross-sectional views of the hanger 104 taken along the line D-D in FIG. 11. FIG. 12A shows the swivel 305 with the bearings 340 received in the grooves 344 at position "B" of FIG. 11. FIG. 13B shows the swivel 305 with the bearings 340 in the locked position "C" of FIG. 11.

Figure 13:
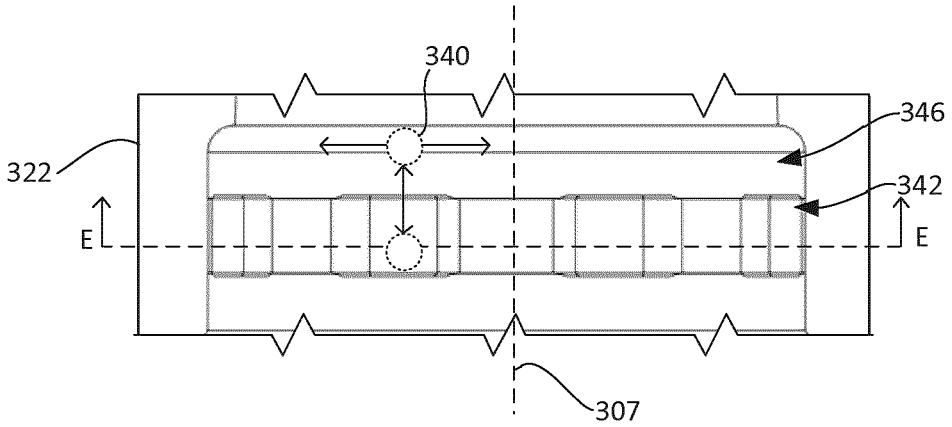
FIG. 13 is an enlarged partial side view of an alternate outer housing according to another embodiment.
Figure 14:
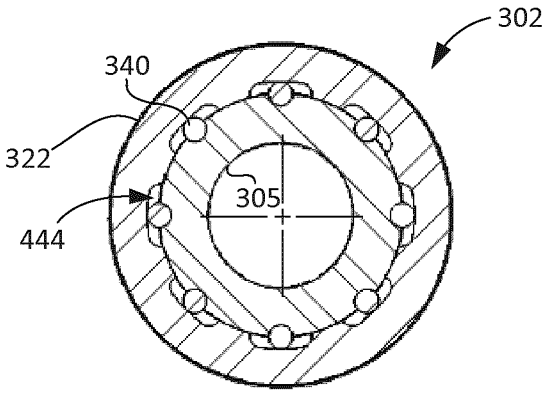
FIG. 14 is a bottom cross-sectional view of the alternate outer housing taken along the line E-E in FIG. 13.

FIGS. 13 and 14 show an alternate, simpler configuration for locking the swivel 305 and outer housing 302. FIG. 13 is an enlarged partial side view of the outer housing 302. FIG. 13 shows the clearance space 346 and grooves 444 in the inner wall 342 as visible for illustrative purposes, although they would normally be hidden from view. FIG. 14 is a bottom cross-sectional view of the hanger 104 taken along the line E-E in FIG. 13. The grooves 444 in this alternate embodiment are simply vertical grooves that open to the clearance space 346. Thus, the swivel 305 (FIGS. 9A and 9B) may be lowered to move the bearings 340 into corresponding grooves 444 to rotationally lock the swivel 305. To rotationally unlock the swivel 305, it must simply be lifted to move the bearings 340 out of the grooves 444 and into the clearance space.

Overall operation of the torque release tubing rotator system 100 will now be described with reference to FIGS. 3A, 4A and 10. The tubing rotator 102 may be mounted to wellhead equipment such as a wellhead or tubing head (not shown). The tubing hanger 104 may be landed in the rotator body 108 and split drive mandrel 118, and the tubing mandrel 304 may be connected to production tubing (not shown). Other wellhead equipment (e.g. BOP) may be mounted on the tubing rotator 102.

To rotate the production tubing, the drive system 106 drives rotation of the worm gear 116 in the forward direction, which, in turn, drives rotation of the outer driven portion 130 of the split drive mandrel 118 in the first (forward) rotation direction. The rotation of the outer mandrel driven 130 causes the one-way locking mechanism 134 to engage the inner mandrel portion 132, thereby transferring the torque and rotation to the inner mandrel portion 132.

The rotation of the inner mandrel portion 132 is transferred to the hanger 104 via the friction engagement formed between the hanger 104 and the inner mandrel portion 132, which, in turn, rotates the production tubing.

When the drive system 106 is stopped, torque that may be built up in the production tubing (not shown) may be released by the tubing rotator 102. The tubing hanger 104 may also be used to release the torque. First, stopping the rotation of the outer driven portion 130 in the first direction may, by itself, allow the one-way locking mechanism 134 to disengage. If the one-way locking mechanism 134 disengages, the inner mandrel portion 132 and the hanger 104 may backspin (i.e. rotate in the reverse direction) to release the torque.

If the one-way locking mechanism 134 does not automatically disengage, the bi-directional coupling 170 allows the worm gear 116 to be manually rotated in the reverse direction. This manual reverse rotation backs off the outer driven portion 130, which may, in turn, release the locking mechanism 134 and, thus, the trapped torque.

Torque may also be released by unlocking/lifting the swivel 305 in the tubing hanger 104 from the locked to the unlocked configuration. For example, the tubing hanger 104 may be used to release torque during well servicing operations. When the hanger 104 is installed, the swivel 305 may initially be set to the locked position. When the wellhead equipment (not shown) mounted on the tubing rotator 102 is removed for servicing the rotator 102, tubing or other equipment may be connected to the swivel 305 (e.g. via a threaded connection). The tubing connected to the swivel 305 move the swivel 305 to the unlocked position as it lifts up on the hanger 104. Thus, when the hanger 104 is disengaged from the rotator 102, it may backspin to release torque in the tubing connected to the tubing mandrel 304. Since the hanger 104 is freely rotatable relative to the swivel 305, when unlocked, the hanger 104 may backspin without causing damage to the tubing connected to the swivel or other equipment in the vicinity.

To re-set the swivel 305, weight may simply be placed on the swivel by a handling joint (not shown) or other equipment.

In some embodiments, the tubing hanger comprises a one-way rotational locking mechanism similar to the tubing rotator described herein. For example, the tubing hanger may comprise an outer portion and an inner portion, where either the outer or inner portion (or both) is rotatably driven. The one-way locking mechanism couples the inner and outer portions. The first and second portions may be ring or tubular shaped and may be concentrically aligned. The one-way locking mechanism may be a one-way rotational clutch similar to the example locking mechanism 134 shown in FIGS. 2 to 7B and described above. The one-way locking mechanism of the tubing hanger may locking the outer and inner portions for rotation in a first direction (i.e. the forward direction), while allowing the non-driven portion (e.g. second portion) to rotate in a second direction (i.e the backward direction) to release trapped torque. In some embodiments, the outer portion is driven (similar to the tubing rotator discussed above). In other embodiments, the inner portion is driven rather than the outer portion.

The outer driven portion of the tubing hanger may be an outer housing (similar to outer housing 302 in FIGS. 8 to 10), and the inner portion of the tubing hanger may be a tubing mandrel (similar to the tubing mandrel 304 in FIGS. 8 to 10). In another embodiment, the outer housing may comprise both the first and second portions coupled by the one-way locking mechanism. For example, rather than a threaded connection, the first and second housing pieces 322 and 324 in FIGS. 9A and 9B may be modified to be coupled by a one-way locking mechanism similar to the example locking mechanism 134 shown in FIGS. 2 to 7B. In still another embodiment, the outer portion may be an outer ring, and the inner portion may be similar to the tubular outer housing described above, but with the outer ring extending about a periphery of the housing. In some embodiments, the inner portion of the tubing hanger is driven in the forward rotation direction for rotating the production tubing, and the outer portion is locked with the inner portion for that rotation. Other variations are also possible. The one-way locking mechanism may be a friction clutch such as a bearing clutch or a sprag clutch, for example.

As described above, the system described herein may provide multiple ways for releasing torque trapped in production tubing in a manner that may be safer and/or less likely to damage wellhead equipment or cause injury or death to workers.

It is to be understood that a combination of more than one of the approaches described above may be implemented. Embodiments are not limited to any particular one or more of the approaches, methods or apparatuses disclosed herein. One skilled in the art will appreciate that variations, alterations of the embodiments described herein may be made in various implementations without departing from the scope of the claims.

The invention claimed is:

1. A wellhead tubing rotator, comprising:

a rotator body for mounting to wellhead equipment, the rotator body defining a first bore therethrough;

a split drive mandrel mounted in the first bore and rotatably coupled to the rotator body, the split drive mandrel defining a second bore therethrough for receiving at least a portion of a tubing hanger therein, and comprising:

an outer driven portion;

an inner mandrel portion; and a one-way locking mechanism coupling the outer driven portion and the inner mandrel portion, wherein the one-way locking mechanism comprises a one-way clutch.

2. The wellhead tubing rotator of claim 1, wherein:

the one-way locking mechanism engages to rotationally lock the inner mandrel portion with the outer driven portion when the outer driven portion is rotated in a first rotation direction; and when disengaged, the one-way locking mechanism allows the inner mandrel portion to rotate with respect to the outer driven portion in a second rotation direction opposite to the first rotation direction.

3. The wellhead tubing rotator of claim 1, wherein the one-way clutch comprises a one-way friction clutch.

4. The wellhead tubing rotator of claim 3, wherein the one-way friction clutch comprises:

an outer guide defined by an inner surface of the outer driven portion;

an inner guide defined by an outer surface of the inner mandrel portion; and a plurality of engagement elements received in between the inner and outer guides.

5. The wellhead tubing rotator of claim 4, wherein one of the inner guide and the outer guide defines a plurality of tapered recesses, and each of the engagement elements is positioned in a respective one of the tapered recesses, and wherein each said tapered recess is shaped such that movement of the outer guide in the first rotation direction causes the engagement elements to frictionally engage the inner and outer guides.

6. The wellhead tubing rotator of claim 2, further comprising a mechanical linkage coupled to the outer driven portion and couplable to a drive system to transfer torque from the drive system to the outer driven portion.

7. The wellhead tubing rotator of claim 6, further comprising a bi-directional coupling mechanism for coupling the mechanical linkage to a drive shaft of the drive system, the bi-directional coupling allowing the mechanical linkage to be: driven in a forward direction by the drive system to rotate the outer driven portion in the first rotation direction; and moved in a reverse direction to rotate the outer driven portion in the second rotation direction.

8. The wellhead tubing rotator of claim 7, wherein the outer driven portion comprises outer teeth, the mechanical linkage comprises a worm gear, the worm gear extends through a passage in the body to engage the teeth of the outer driven portion.

9. The wellhead tubing rotator torque of claim 1, wherein the inner mandrel portion is shaped to grippingly engage the at least a portion of the tubing hanger received therein.

10. The wellhead tubing rotator of claim 1, further comprising a bi-directional coupling for coupling a rotational driving member and a driven member, the bi-directional coupling comprising:

a first coupling member fixable to the rotational driving member to rotate about a rotational axis, the first coupling member comprising first threads aligned about the rotational axis;

a second coupling member fixable to the driven member and comprising second threads, wherein the first coupling member threadingly engages the second coupling member such that relative rotation of the first and second coupling members causes axial movement of the second coupling member relative to the first coupling member; and a first axial stop that limits axial movement of the first coupling member in a first direction relative to the second coupling member when the first coupling member abuts the first axial stop.

11. The wellhead tubing rotator of claim 10, wherein one of the first and second coupling members comprises a generally cylindrical body, and the other of the first and second members defines a hole, the cylindrical body being threadingly received in the hole.

12. The wellhead tubing rotator of claim 1, further comprising a tubing hanger, wherein the tubing hanger further comprises:

an outer portion;

an inner portion, wherein one of the outer and inner portions is driven; and a one-way rotational locking mechanism coupling the outer and inner portions.

13. The wellhead tubing rotator of claim 1, further comprising a tubing hanger, wherein the tubing hanger further comprises:

an outer housing defining a longitudinal bore therethrough and having an upper end and a lower end;

a locking swivel rotatably coupled to the outer housing and extending from the upper end of the outer housing;

wherein the swivel is movable between:

a locked position in which rotation of the outer housing relative to the swivel is restricted; and an unlocked position in which the outer housing is freely rotatable relative to the swivel.

14. The wellhead tubing rotator of claim 13, wherein the tubing hanger further comprises a tubing mandrel extending downward from the outer housing.

15. The wellhead tubing rotator of claim 14, wherein the tubing mandrel is releasably coupled to the outer housing.

16. The wellhead tubing rotator of claim 15, wherein the tubing mandrel is threadably coupled to the outer housing.

17. The wellhead tubing rotator of claim 15, wherein the outer housing comprises an upper housing piece and a lower housing piece operatively coupled thereto, and wherein the tubing mandrel is threadably coupled to the lower housing piece.

18. The wellhead tubing rotator of claim 14, wherein the swivel is tubular, and the swivel, the outer housing, and the tubing mandrel collectively define a fluid passageway through the tubing hanger.

19. The wellhead tubing rotator of claim 13, wherein the swivel is axially movable, relative to the outer housing, between the locked position and the unlocked position.

20. The wellhead tubing rotator of claim 19, wherein the swivel comprises a first interlocking element, the outer housing comprises a second interlocking element, and the first interlocking element releasably engages the second interlocking element to restrict relative rotation of the swivel when the swivel is in the locked position.

21. The wellhead tubing rotator of claim 20, wherein one of the first and second interlocking elements comprises one or more projecting elements, and the other of the first and second interlocking elements comprises one or more recesses or grooves positioned to receive the one or more projecting elements when the swivel is moved to the locked position.

22. The wellhead tubing rotator of claim 21, wherein the outer housing defines a clearance space in the bore of the outer housing that provides clearance for movement of the one or more projecting elements of the swivel during rotation of the swivel in the unlocked position.

23. The wellhead tubing rotator of claim 22, wherein the one or more recesses or grooves open to the clearance space to allow movement of the one or more projecting elements between the clearance space and the one or more recesses or grooves.

24. The wellhead tubing rotator of claim 13, wherein the outer housing is shaped to be landed in the wellhead tubing rotator.

* * * * *